United States Patent [19]

Trevisan

[11] Patent Number: 4,942,891

[45] Date of Patent: Jul. 24, 1990

[54] EYEBROW-COVER ELEMENT

[76] Inventor: Sandra Trevisan, Via F. Filzi 5, 36050 Quinto Vicentino (Prov. of Vicenza), Italy

[21] Appl. No.: 152,505

[22] Filed: Feb. 5, 1988

[30] Foreign Application Priority Data

Feb. 10, 1987 [IT] Italy ..... 63221/87[U]

[51] Int. Cl.[5] ..... A45O 40/30

[52] U.S. Cl. ..... 132/216

[58] Field of Search ..... 132/88.5, 216, 319, 132/333, 213; 63/2

[56] References Cited

U.S. PATENT DOCUMENTS

| | | | |
|---|---|---|---|
| 1,055,382 | 3/1913 | Brennan | 132/333 |
| 1,812,425 | 6/1931 | Wosse | 132/88.5 |
| 2,842,142 | 7/1958 | Peck | 132/88.5 |
| 3,823,723 | 7/1974 | Miller | 132/201 |
| 4,024,879 | 5/1977 | Stryker | 132/88.5 |

FOREIGN PATENT DOCUMENTS 1596742 7/1970 France .

*Primary Examiner*—John J. Wilson
*Assistant Examiner*—Adriene J. Lepiane
*Attorney, Agent, or Firm*—Guido Modiano; Albert Josif

[57] ABSTRACT

The eyebrow cover element comprises an elongate, arcuate body made of material selected from synthetic material, metal, and precious metals, and having on one side thereof, a concavity having an inner surface. The concavity defines a containment region for accommodating an eyebrow, and the inner surface is provided with an adhesive for attaching the cover element to an eyebrow. On another side of the body, ornamental motifs may be provided which can match other personal accessories such as bracelets, rings and brooches.

4 Claims, 1 Drawing Sheet

EYEBROW-COVER ELEMENT

BACKGROUND OF THE INVENTION

The present invention relates to an eyebrow-cover element.

As is known, since time immemorial the problem of makeup is particularly felt by women.

While eye and face makeup are executed by means of the application of coloured substances so as to adequately modify the natural colours of the face, with regard to the eyebrows makeup is performed by modifying their shape. More particularly, the eyebrows are generally reduced in width and their shape is modified so as to make it more harmonious, or in any case more suitable to individual requirements, by means of the removal of some of the hairs which compose them. In some cases, when the hairs have an excessive dispersion, their total removal is necessary to proceed to the reconstruction of the eyebrow by means of coloured substances.

The removal of the hairs constituting the eyebrows is responsible for some disadvantages. In fact this removal causes an irritation of the skin with unavoidable reddenings and the possible application of coloured substances may aggravate this irritation and, in some cases, may not be tolerated by the skin, causing allergy phenomena.

Another disadvantage is due to the fact that this operation requires a relatively long time and great care on the part of the person performing it.

SUMMARY OF THE INVENTION

The aim of the present invention is to solve the above described problems by providing an eyebrow-cover element which allows to vary the aesthetics of the eyebrows without necessarily implying the removal of hairs or the application of colored substances.

Within this aim, an object of the invention is to provide an eyebrow-cover element which is simple and rapid to apply.

Another object of the invention is to provide an eyebrow-cover element which can be produced in a simple manner with low production costs.

Not least object of the invention is to provide an eyebrow-cover element which can be configured as a personal accessory matchable with clothing and with other personal accessories such as for example earrings, bracelets, rings, etc.

This aim, as well as these and other objects which will become apparent hereinafter, are achieved by an eyebrow-cover element, characterized in that it comprises a body having an elongated configuration and being provided with a concavity defining a containment region adapted to at least partially accommodate an eyebrow, said body being applicable on said eyebrow through adhesion means.

BRIEF DESCRIPTION OF THE DRAWINGS

Further characteristics and advantages of the invention will become apparent from the description of a preferred but not exclusive embodiment of an eyebrow-cover element according to the invention, illustrated only by way of non-limitative example in the accompanying drawings, wherein.

DESCRIPTION OF THE PREFERRED EMBODIMENTS

Figure 1:
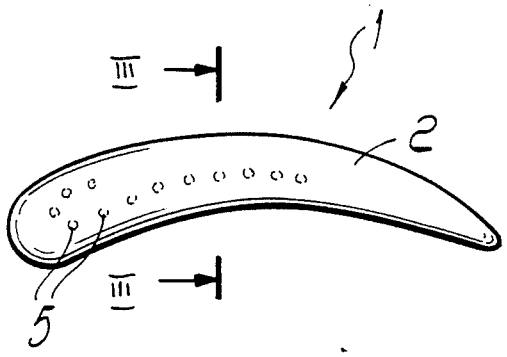
FIG. 1 is a schematic plan view of an eyebrow-cover element.
Figure 2:
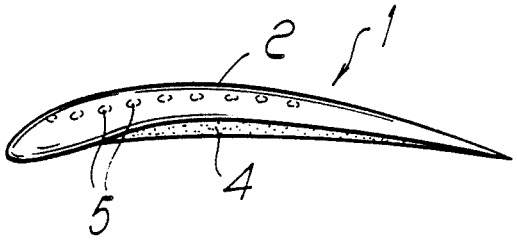
FIG. 2 is a schematic lateral elevation view of the eyebrow-cover element.
Figure 3:
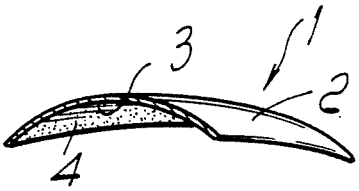
FIG. 3 is an enlarged sectional view of FIG. 1 along the axis III—III.
Figure 4:
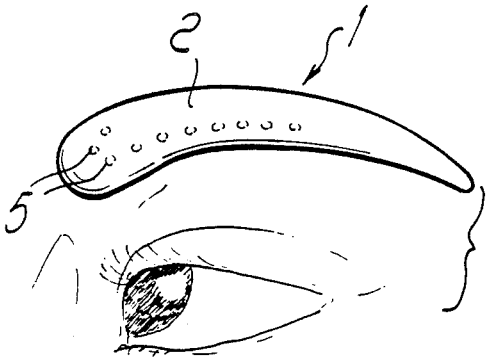
FIG. 4 illustrates the application of the eyebrow-cover element.

With reference to the above described figures, the eyebrow-cover element according to the invention, generally indicated by the reference numeral 1, comprises a body 2 with an elongated configuration which has on its inner side, to be directed towards the face, a concavity which defines a containment region adapted to partially or completely accommodate an eyebrow.

The body 2 is destined to be applied to the face, on the eyebrow, through adhesion means which may be constituted by known types of adhesive applied at the interior of the concavity 3, or at the perimetral edge thereof. Said adhesion means may also be constituted by a self-adhesive layer 4 made of a known type of material, applied on the inner surface of the concavity 3, so as to facilitate both its application and its removal. Preferably the body 2 has an arcuate configuration so as to reproduce the configuration of an eyebrow with the desired width and length.

According to aesthetic requirements, the body 2 may have various configurations and on its outer side, that is, on the outer part opposite to the concavity 3, may have ornamental motifs 5.

The body 2 may be provided in materials available at low cost, in metal or in synthetic materials, but may also be provided in precious metals with decorations and an aesthetic line matching the makeup and other personal accessories, such as for example rings, bracelets, brooches, etc.

The use of the eyebrow-cover element according to the invention is evident from what has been described and illustrated and, in particular, it is evident that it can be applied in a rapid manner on an eyebrow by means of simply exerting pressure on the eyebrow-cover element itself.

In practice it has been observed that the eyebrow-cover element according to the invention fully achieves the intended aim since, by concealing the eyebrow, it allows to modify its aesthetics according to the various requirements without necessarily implying the partial or total removal of the hairs which constitute the eyebrow itself.

Another advantage is that of being able to frequently vary the eyebrow-cover element according to the aesthetical requirements.

The eyebrow-cover element thus conceived is susceptible to numerous modifications and variations, all within the scope of the inventive concept; furthermore, all the details may be replaced with technically equivalent elements.

In practice, the materials employed, as well as the dimensions, may be any according to the requirements and the state of the art.

I claim:

1. An eyebrow-cover element comprising, at least one body defining a substantially elongate arcuate configuration, said body having at least one side and at least one other side, at least one concavity defined at said one side of said body, at least one inner surface defined by said concavity, a perimetral edge defined by said inner surface, adhesion means, said adhesion means being at least temporarily associable with at least one of said inner surfaces of said concavity and said perimetral edge of said inner surface, for at least temporarily attaching said body to an eyebrow, at least one containment zone defined by said concavity and being adapted for at least partially accommodating an eyebrow and said adhesion means, ornaments defined on said other side of said body, wherein said ornaments comprise ornamental motifs.

2. An eyebrow-cover element according to claim 1, wherein said ornamental motifs are adapted for matching at least one personal accessory of user.

3. An eyebrow-cover element according to claim 1, wherein said body is made of synthetic materials.

4. An eyebrow-cover element according to claim 1, wherein said body is made of metals.

* * * * *